United States Patent [19]

Cantwell

[11] 3,941,446

[45] Mar. 2, 1976

[54] ELECTRICAL CONNECTOR

[75] Inventor: Joseph R. Cantwell, Dix Hills, N.Y.

[73] Assignee: Sperry Rand Corporation, New York, N.Y.

[22] Filed: Aug. 21, 1974

[21] Appl. No.: 499,243

[52] U.S. Cl. ..... 339/75 M; 339/113 R; 339/274

[51] Int. Cl.[2] ..... H01R 13/54

[58] Field of Search ..... 339/47–49, 339/75, 113, 274

[56] References Cited

UNITED STATES PATENTS

| | | | |
|---|---|---|---|
| 2,748,364 | 5/1956 | Kamm | 339/75 MP |
| 2,770,788 | 11/1956 | Eschner, Jr. | 339/75 M |
| 2,877,439 | 3/1959 | Avery | 339/49 R |
| 2,881,404 | 4/1959 | Kamm | 339/75 MP |
| 2,945,201 | 7/1960 | Waninger | 339/49 R |
| 3,129,044 | 4/1964 | Lyman, Jr. et al. | 339/184 M |
| 3,315,212 | 4/1967 | Peterson | 339/75 M |
| 3,388,590 | 6/1968 | Dryden | 339/113 R |

*Primary Examiner*—Joseph M. McGlynn
*Attorney, Agent, or Firm*—Howard P. Terry; Seymour Levine

[57] ABSTRACT

An electrical connector, having a multiplicity of electrical conductors, in which pressure, to establish electrical contact between conductors, is generated by means of a single external force. Maintenance of adequate contact pressure, for all contacts, is determined by incorporating a single pressure sensing device which monitors the pressure applied to the contacts.

4 Claims, 5 Drawing Figures

ELECTRICAL CONNECTOR

BACKGROUND OF THE INVENTION

1. Field of the Invention

This invention relates to the multiple connections of electrical equipments. More particularly, this invention relates to a technique for providing multiple electrical connections with extremely high current and reliability ratings.

2. Description of the Prior Art

Current rating and operation reliability of an electrical connection is dependent upon the electrical contact pressure between the contacting elements. Present multi-pin electrical connectors consist of male-female pairs in which each pair has its own spring loading to provide the mechanical pressure needed to establish proper electrical connection. To hold the over-all size of a multi-pin connector to required dimensions, it is often necessary to minimize pin space requirements. In order to accomplish this, each pin-spring combination is designed as a fine structure and built to tight tolerances. Reduction of spring tension and pin wear, which effect these tolerances, results in the most common cause of connector failure - loss of electrical contact between male and female pins. As the number of pins in the connector is increased, tolerances become more critical and its reliability decreases (failure rate increases). This decrease in reliability is two-fold; the pins are more subject to damage and the over-all reliability decreases with the increase in the number of pins. Therefore, it is highly desirable to have an arrangement in which a single force assures uniformly high contact pressures in a high density multi-contact connector.

SUMMARY OF THE INVENTION

The present invention relates to high density multi-pin electrical connectors in which extremely high connector current ratings are possible. This is accomplished by means of the unique arrangement of electrical contacts and the application of a single external force in a manner that insures high contact pressure across each contacting pair of conductors. The applied force can be made as large as desired to insure good electrical contact, thus providing high current ratings and reliable operation.

Since a single force is applied externally, connector failure, due to loss of contact pressure, may be determined by including a pressure sensing device to monitor the pressure applied to the contact. The external force can be applied by means of a system of V-shaped springs, force transmitting rods and a cam shaped lever. Pressure generated by this system is applied directly to a stack of contact pairs separated by appropriate insulators or to a semi-compressible conductor housing which provides the necessary insulation between the contacting pairs of conductors.

The invention, as described herein, provides the following advantages over present multi-pin connectors:

1. A uniform force as large as desired can be applied to all contacts, thus assuring reliable operation.

2. The force generating device can be external to the array of contacts, thus its proper operation can be readily checked.

3. Since the force generating device is not an integral part of each contact, contacts can be made small and extremely high densities are possible.

4. Since the force can be made as large as required, electrical contact resistance is minimized, permitting high current ratings for the individual contacts.

5. The pressure across all contacts may be remotely monitored by a single pressure sensing device.

DESCRIPTION OF THE PREFERRED EMBODIMENTS

The present invention utilizes a single, external force to provide the mechanical pressure needed to establish proper electrical contact between corresponding conductors in an electrical connector.

Figure 1:
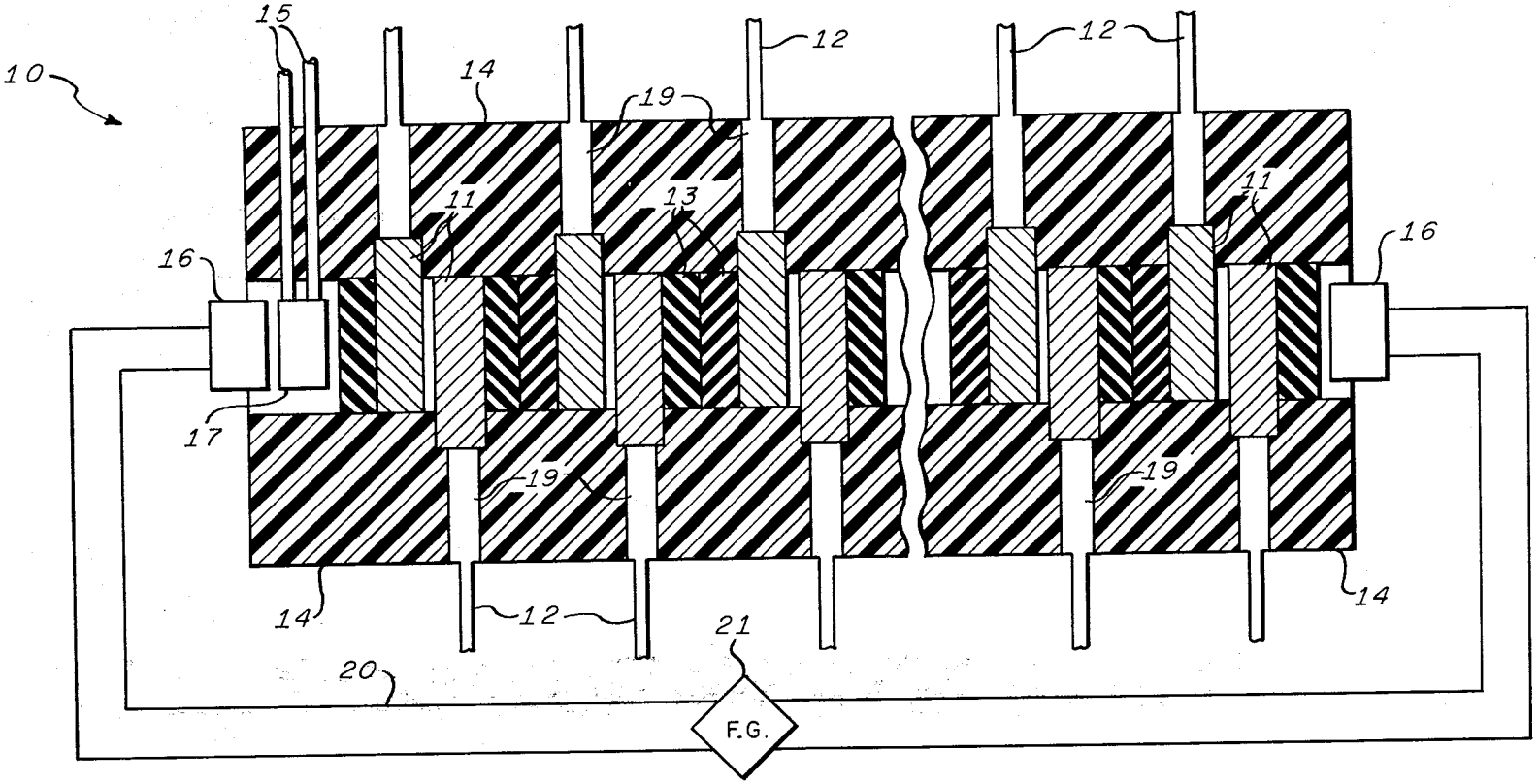
FIG. 1 is a cross-sectional view of a preferred embodiment incorporating the present invention. In this configuration, contacting conductor pairs are separated by insulating members.

Referring to FIG. 1, a configuration of the connector 10 may consist of a two-part housing 14, a comb-like array of rectangular conductor contacts 11 inserted in each part, with the contacts in one part of the housing interwoven with those of the other part, each contact in the array having a corresponding contact in the other array, two such contacts forming a pair, and rectangular insulating members 13 to separate pairs of contacting conductors. The comb-like array of contacts may be arrayed to form a rectangular configuration. Spacing of the conductors within an array need not be identical to the spacing of conductors within another array and spacing between arrays may also vary. Each part of the housing 14 can be molded, with rectangular slots for inserting the conductors 11 therein, using a material such as diallyl phthalate. Conductor 11 retention within the housing can be provided by barbing the edges of a portion of the conductor that is inserted therein or by any other conventional method. The insulating members 13 may be affixed to the connector housing 14 in a similar manner or secured to the conductor contacts 11. Means 19 for connecting the conductor contacts 11 to the external wiring 12 can be provided by terminating the conductor contacts 11 with solder islets or weld tabs.

A single force, to insure proper electrical contact between contacting conductors, is applied by a force generating system which consists of a force generator 21, force transmission structure 20 and two end plates 16. The force is supplied to the system by the force generator, transmitted to the end plates via the transmission structure, and applied to the connector by the end plates. A pressure sensing device 17 may be included in the system to monitor the force applied. Information concerning the sufficiency of the applied force is transmitted through wires 15 to some appropriate indicator.

Proper spacing of the two parts of the housing can be accomplished by means of sidewalls, of appropriate height, which are on both sides and run the length of each part. These sidewalls abut when proper connection is made. To insure that the contacts of one part of the connector mate with their corresponding conductor contacts of the other part, a keying mechanism, in the form of posts and grooves, may be included along the abutting edges of the sidewalls.

Figure 4:
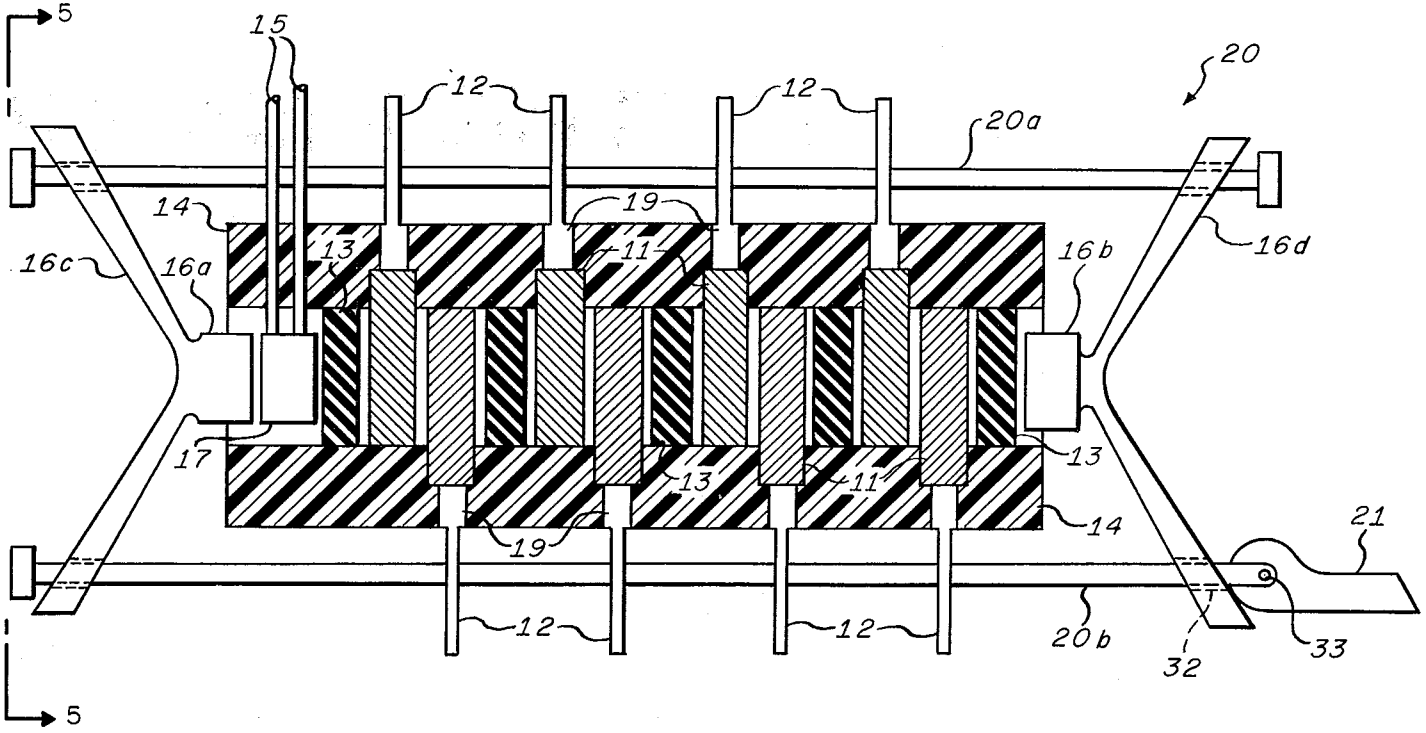
FIG. 4 is a cross-sectional view of the configuration of FIG. 1 with a given force generating system.

FIG. 4 illustrates a possible method for applying pressure to the contacts. This force generating system includes a force generator which is a cam shaped lever 21, a force transmission structure 20 which consists of two connecting rods 20*a* and 20*b* and end plates 16 which consist of two blocks 16*a* and 16*b* to each of which is attached a V-shaped spring 16*c* and 16*d*.

Figure 5:
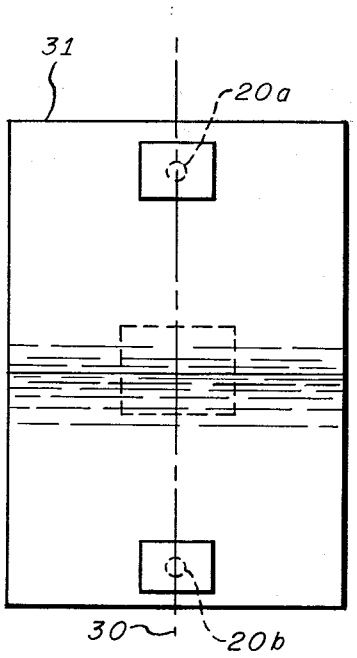
FIG. 5 is a front view of an end plate assembly through which the force is applied.

Rod 20*a* of the force transmission structure connects the two V-shaped springs. This is accomplished by attaching one end of rod 20*a* to the spring 16*c* at an appropriate distance from edge 31, FIG. 5, on the center line 30, FIG. 5, that is perpendicular to the V-apex and attaching the other end of rod 20*a* to spring 16*d* at the same point on the center line of spring 16*d* as the attachment to spring 16*c*. One end of the other rod 20*b* is attached to spring 16*c* on the side opposite the V-apex from that rod 20*a* at the same distance from the opposite edge and on the same center line 30. Rod 20*b* runs through a hole 32 in spring 16*d* and is attached to the cam-shaped lever 21. The lever 21 is rotatably connected to the rod 20*b*, thereby allowing rotation of the lever about an axis which runs through the point of attachment 33 and is perpendicular to rod 20*b*. The hole 32 is located on the opposite side of the V-apex of the attachment of the rod 20*a* to the spring 16*d* and is at the same point on the spring 16*d* as its opposite end's attachment to the spring 16*c*. When the lever 21 is rotated to position its maximum radius in line with the force transmission rod 20*b*, it makes contact with and applies a force to the spring 16*d*. This force is transmitted through rod 20*b*, spring 16*c*, rod 20*a* and spring 16*d* to the blocks 16*a* and 16*b* of the end plates 16, through which the force is applied to the conductor contacts 11.

Figure 2:
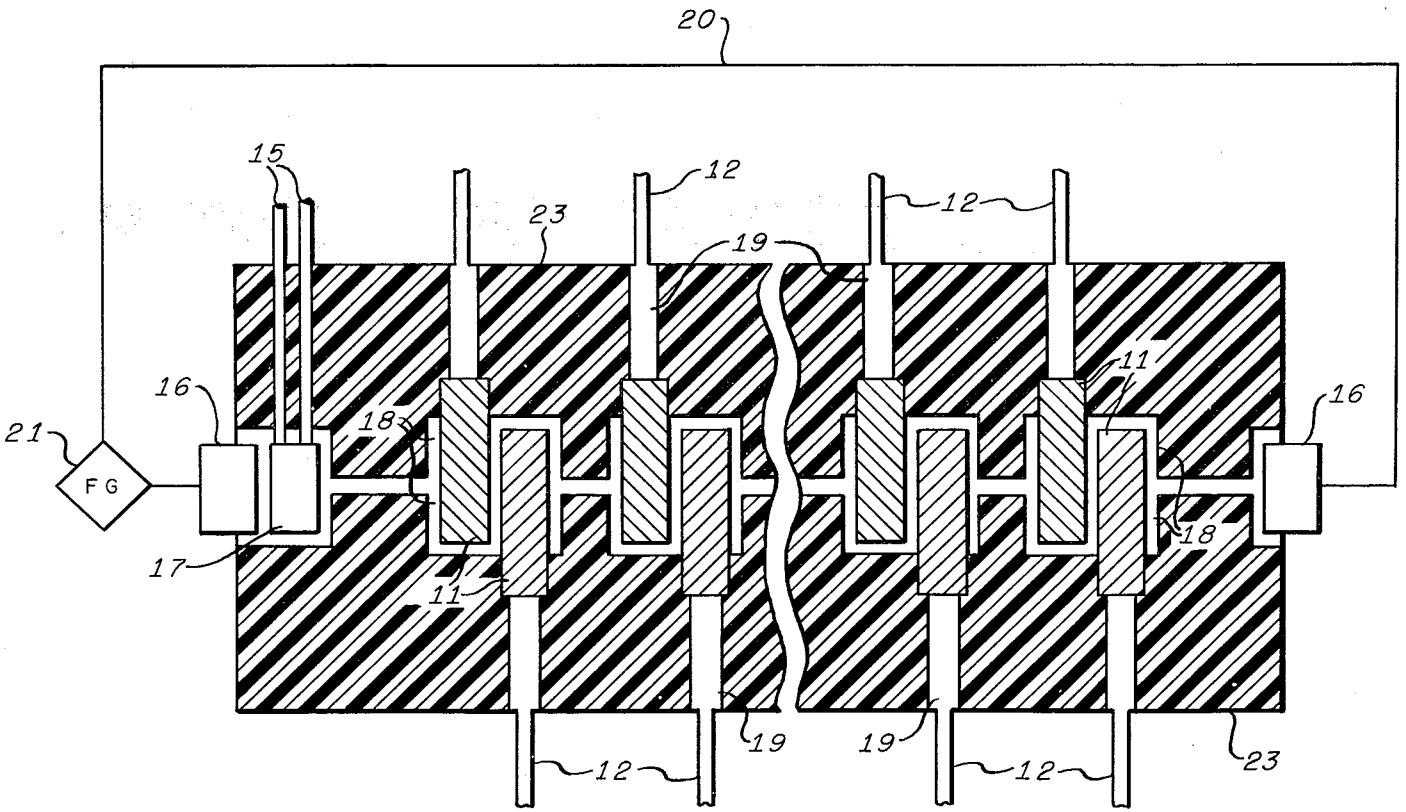
FIG. 2 is a cross-sectional view of an alternate embodiment of this invention. In this configuration, insulation between contacting conductor pairs is provided by the connector housing.

A second version of the invention, shown in FIG. 2, utilizes a two part housing 23 wherein the two parts 23 are identical and made of a semi-compressible insulating material such as polyurethane. Each part of the housing 23 contains rectangular grooves 18 in a linear or rectangular arrangement with equal or random spacing. These grooves 18 are sufficiently large to accommodate the fixed mounting of one of the conductors 11 and the injection of the corresponding conductor 11 of the other part of the housing 23 with which it is to make contact when the two parts of the housing 23 are connected together. Means 19 for retention of the conductors in the housing 23 and means for connection to the external wiring 12 are similar to that employed for the connector of FIG. 1. A single force supplied by the force generating system consisting of end plates 16, force generator 21, and force transmission structure 20 is applied directly to the semi-compressible material comprising the housing 23 and transmitted through the housing 23 to the contacting conductors 11 to insure proper electrical contact. A pressure sensing device 17 may be included to monitor the force applied.

Figure 3:
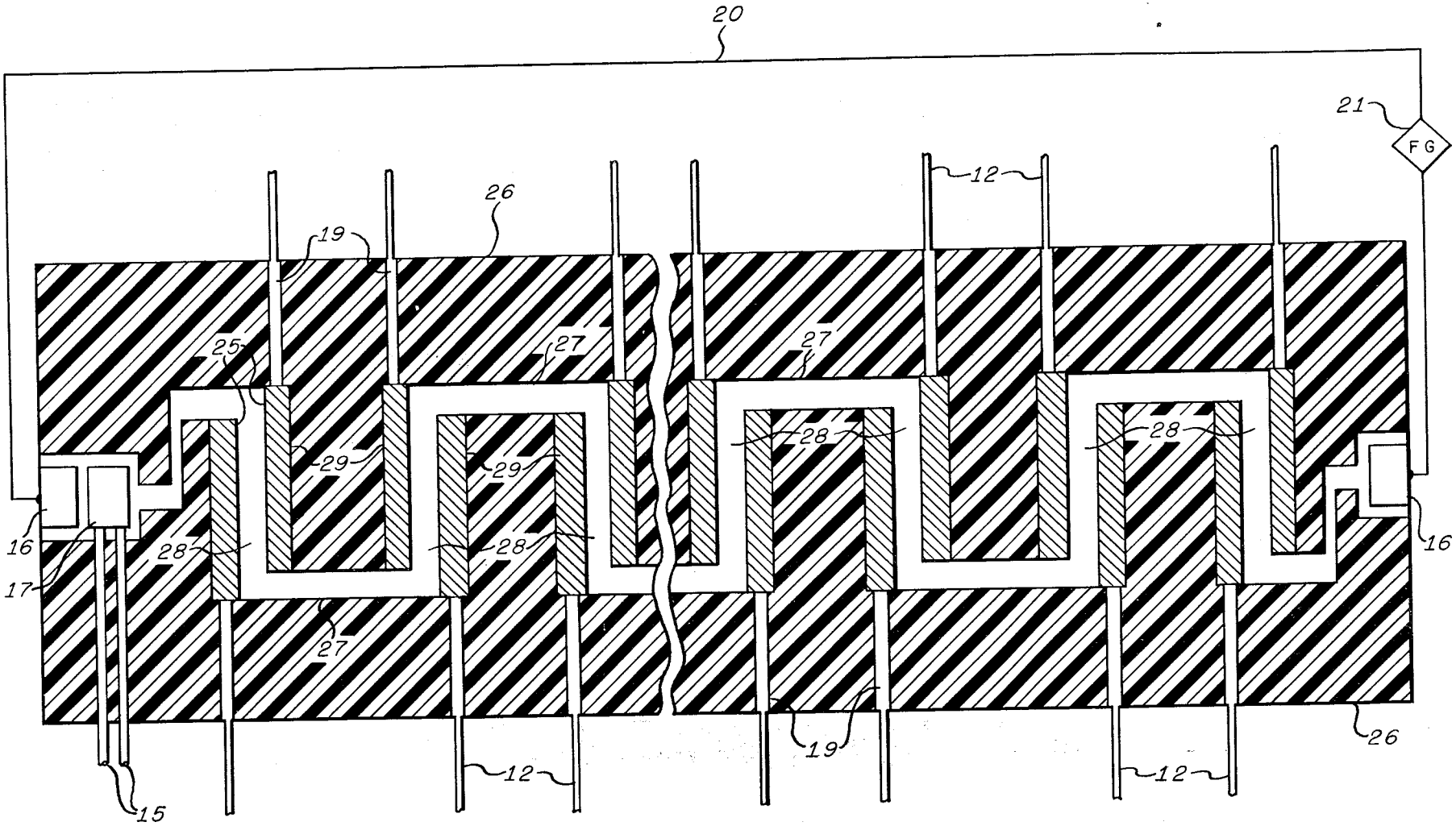
FIG. 3 is a cross-sectional view of another alternate embodiment of this invention. In this configuration, conductors are secured to the sidewalls of grooves in the conductor housing. The connector housing provides insulation between contacting pairs of conductors.

Another version of the invention shown in FIG. 3, utilizes a two part housing 26 which is constructed of a semi-compressible material, which may be of the same material employed for the housing 23 of FIG. 2. The housing 26 containing grooves 28 of appropriate depth. The grooves 28 may form a linear or rectangular array with equal or random spacings. Conductors 25 are secured to the groove sidewalls 29 that are perpendicular to the force applied by the force generating system which comprises end plates 16, force generator 21 and force transmission structure 20. The grooves of the two parts of the housing 26 are interwoven and keyed to insure proper mating of conductor pairs. Connection of the two parts of the housing 26 is made by applying a force perpendicular to the base 27 of the groove 28. When the two parts of the housing 26 are connected, force is applied to the housing 26 via the end plates 16 of the force generating system, through the semi-compressible material comprising the housing 26, to the conductors 25 thereby insuring proper electrical contact.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. An electrical connector comprising:

a housing means made of electrical insulating material containing two mating parts, a plurality of electrical conductors contained and arranged in each of said housing parts such that each conductor in one of said housing parts mates with a corresponding conductor in said other housing part, forming conductor pairs, insulating means disposed between said conductor pairs, means for connecting external circuits to said conductors through said housing, two end plates, a first end plate and a second end plate, said first end plate located at one end of said housing and said second end plate located at the other end, said end plates including a rectangular block and a rectangular spring shaped to form a V, said spring attached to said block at the apex of the V, with said spring of said first end plate having at least one hole on one side of said apex, a force transmission structure including two sets of rigid rods, a first set and a second set one end of each of said rods contained in said first set being attached to said spring of said second end plate, the other ends extending through said holes of said spring of said first end plate, said rods of said second set being attached at one end to said spring of said first end plate and at the other end to said spring of said second end plate, said second set attachments being on the opposite side of said apexes from said first set of attachments and said holes, a force generating device including at least one cam shaped lever, and means for connecting the ends of said first set of rods which extend through said holes of said spring of said first end plate to said cam shaped lever whereby movement of said lever in an appropriate direction applies an external force that is transmitted to said conductors of said conductor pairs.

2. An electrical connector as recited in claim 1 further including a pressure sensing device to monitor the pressure applied to said contacting conductor pairs.

3. An electrical connector as recited in claim 1 in which:

said housing means is made of a semi-compressible insulating material, each mating part of said housing means being identical and each containing an array of appropriately spaced rectangular grooves, said grooves in one of said parts facing a corresponding groove in said other part and aligned therewith, said grooves being sufficiently large to accommodate one pair of said conductor pairs, one conductor of each of said conductor pairs inserted in each of said grooves of said mating parts with corresponding grooves containing corresponding conductors which form said conductor pairs, and said insulating means between said pairs of contacting conductors being provided by said semi-compressible insulating material of which said housing is made whereby said external force is applied to said housing causing compression of said semi-compressible material thereby accomplishing electrical contact between corresponding conductors of said conductor pairs.

4. An electrical connector as recited in claim 1 in which said housing means is constructed of a semi-compressible insulating material, each part of said housing containing an array of rectangular grooves wherein said grooves in one of said parts are interwoven with said grooves in said other part in such a manner that a post formed between two grooves in one of said parts is aligned with and can be inserted in a corresponding groove in said other part, said electrical contacts are secured to one pair of opposite walls of said grooves in such a manner that one conductor of a pair of corresponding contacts in one part of said housing faces its corresponding conductor of said pair in said other part, and said insulating means between contacting pairs of electrical contacts is provided by the insulating material in the form of posts between said grooves whereby said external force is applied to said housing causing compression of said semi-compressible material thereby accomplishing electrical contact between corresponding conductors of said conductor pairs.

* * * * *